United States Patent [19]

Blomsterberg

[11] 4,411,751

[45] Oct. 25, 1983

[54] METHOD OF ANODICALLY DEBURRING ARTICLES OF STEEL OR ALUMINIUM ALLOYS IN AN ELECTROLYTIC BATH, AND A BATH FOR CARRYING OUT THE METHOD

[76] Inventor: Karl-Ingemar Blomsterberg, Högstensgatan 60, 423 00 Torslanda, Sweden

[21] Appl. No.: 420,252

[22] PCT Filed: Jan. 15, 1982

[86] PCT No.: PCT/SE82/00011

§ 371 Date: Sep. 14, 1982

§ 102(e) Date: Sep. 14, 1982

[87] PCT Pub. No.: WO82/02407

PCT Pub. Date: Jul. 22, 1982

[51] Int. Cl.[3] ..... C25F 3/04; C25F 3/06

[52] U.S. Cl. ..... 204/129.85; 204/129.95

[58] Field of Search ..... 204/129.4, 129.43, 129.85, 204/129.95, DIG. 9

[56] References Cited

U.S. PATENT DOCUMENTS

| | | | |
|---|---|---|---|
| 3,556,957 | 1/1971 | Toledo | 204/129.95 |
| 4,269,677 | 5/1981 | Blomsterberg | 204/129.85 |

*Primary Examiner*—T. M. Tufariello

[57] ABSTRACT

Articles of steel or aluminium alloy are anodically deburred in an acid solution (pH not above 6.5) containing

| | grams per liter |
|---|---|
| water | 100 to 300 |
| alkali sulphamate | 50 to 150 |
| polyhydric alcohol | 400 to 800 |
| alkali nitrate | 50 to 150 |
| alkali chloride | 50 to 150. |

10 Claims, No Drawings

METHOD OF ANODICALLY DEBURRING ARTICLES OF STEEL OR ALUMINIUM ALLOYS IN AN ELECTROLYTIC BATH, AND A BATH FOR CARRYING OUT THE METHOD

This invention relates to a method of anodically deburring articles of steel or aluminium alloys in an electrolytic bath containing, in addition to water, alkali sulphamate, at least one polyhydric alcohol and at least one soluble chloride, at a bath voltage of 5 to 30 volts and a current density of 2 to 50 amperes per square decimeter.

A method of this kind but applicable to steel articles only is disclosed by the published Swedish patent specification No. 415.891. Said method employs a basic bath, preferably having a pH not below 9, having a comparatively low chloride content (not above 30 grams per liter) and an alkali sulphamate content of at least 200 grams per liter.

The method according to the present invention is characterized thereby that the treatment is carried out in an acid solution having a pH not exceeding 6.5 and containing

| | grams per liter |
|---|---|
| water | 100 to 300 |
| alkali sulphamate | 50 to 150 |
| polyhydric alcohol | 400 to 800 |
| alkali nitrate | 50 to 150 |
| alkali chloride | 50 to 150 |

The new method provides in certain respects a better result of the treatment than the known method referred to. A more attractive appearance is imparted to the articles treated. The method has surprisingly proved applicable also to the treatment of articles of aluminium or aluminium alloys. Consequently, the method also provides the solution of a special technical problem, viz. the deburring of steel articles containing parts consisting of aluminium alloy, or of aluminium articles containing parts consisting of steel.

In a preferred form of the method according to the invention, the alkali salts contained in the bath consist of ammonium salts. This has proved to result in the advantage that an unimportant volume only of gaseous hydrogen is developed during the treatment. In contradistinction thereto, the use of sodium or potassium salts will result in the development of a considerable quantity of gaseous hydrogen, which under certain conditions may cause an explosive mixture of air and hydrogen to form above the surface of the bath. The property of reducing the development of hydrogen exhibited by the ammonium salts was quite unexpected and has as yet found no satisfactory explanation.

The method according to the invention is preferably carried out with bath voltages in the range of 15 to 20 volts and current densities (at the anode surface) of the order of 10 to 20 amperes per square decimeter. The bath temperature should not exceed 25° C. Preferably the temperature is maintained within the range of 15° to 20° C.

The deburring action is known to be due to the fact that the current density and, consequently, the removal of material is considerably more intense at sharp edges and protruding burrs on the article than at the even portions of its surface. This property (usually referred to as "selectivity") depends on several factors, for instance the shape and size of the article treated, the shape of the cathode, the distance between the anode and the cathode, and the conductivity of the bath solution. Too large a conductivity will cause deterioration of the selectivity as well as of the smoothness of the surfaces treated. Moreover, it has been found that in the method according to the invention a substantial improvement of the selectivity can be obtained by supplying the bath current during active intervals separated by idle intervals during which no current flows. Preferably the length of the active interval should amount to ½ to 2 minutes. For the idle interval, a length of a few seconds only, for instance 5 to 10 seconds, is sufficient and suitable.

In the method according to the invention, the conductivity of the bath can be adjusted in a simple way by adjustment of the content of polyhydric alcohol. In the preferred form of the invention in which the alkali salts are ammonium salts, the polyhydric alcohol preferably is ethylene glycol.

The composition specified below is an example of a bath for the method according to the invention.

| | |
|---|---|
| Ethylene glycol | 650 parts by weight |
| Ammonium sulphamate | 100 parts by weight |
| Ammonium nitrate | 100 parts by weight |
| Ammonium chloride | 100 parts by weight |
| Water | 150 parts by weight |

The following conditions are suitable for the anodic deburring of articles of steel or aluminium alloy in the bath above specified:

| | |
|---|---|
| Bath temperature | 15 to 20° C. |
| Bath voltage | 15 to 25 volts |
| Anodic current density | 10–20 amperes per square decimeter |
| pH | 5.0 to 6.5 |

Adjustment of the pH of the bath is carried out by the addition of a small quantity of nitric acid. Fresh additions have to be made from time to time, preferably by means of an automatic dosimeter controlled by a pH meter.

The treatment is preferably carried out intermittently, the lengths of the active interval and the idle interval being chosen within the ranges specified above.

The chemical processes occurring in the bath are complicated and are considered not to be fully clarified. The bath has provided to have a long useful life, provided that its pH is always kept within the stated range of 5 to 6.5 by proper additions of nitric acid, and provided that solid impurities (mostly metal hydroxides) formed during the operation of the bath are successively removed, for instance by filtration.

I claim:

1. A method of anodically deburring articles of steel or aluminium alloys in an electrolytic bath containing, in addition to water, alkali sulphamate, at least one polyhydric alcohol and at least one soluble chloride, at a bath voltage of 5 to 30 volts and a current density of 2 to 50 amperes per square decimeter, carried out in an acid solution having a pH not exceeding 6.5 and containing

| | grams per liter |
|---|---|
| water | 100 to 300 |
| alkali sulphamate | 50 to 150 |
| polyhydric alcohol | 400 to 800 |
| alkali nitrate | 50 to 150 |
| alkali chloride | 50 to 150. |

2. A method as claimed in claim 1, carried out in a solution the alkali salts of which consist at least predominantly of ammonium salts.

3. A method as claimed in claim 1 or 2, carried out in a solution having a total content of alkali sulphamate and alkali nitrate not exceeding 250 grams per liter.

4. A method as claimed in claim 1 carried out in a solution having a pH not lower than 5.

5. A method as claimed in claim 1, wherein the acidity of the solution is adjusted by the addition of nitric acid to the solution.

6. A bath for the anodic deburring of articles of steel or aluminium alloy having the following constituents:

| | grams per liter |
|---|---|
| water | 100 to 300 |
| alkali sulphamate | 50 to 150 |
| polyhydric alcohol | 400 to 800 |
| alkali nitrate | 50 to 150 |
| alkali chloride | 50 to 150 |

and free acid in the quantity required to adjust the pH of the bath to not more than 6.5.

7. A bath as claimed in claim 6 wherein the alkali salts contained therein consist at least predominantly of ammonium salts.

8. A bath as claimed in claim 6 or 7, wherein the total content of alkali sulphamate and alkali nitrate does not exceed 250 grams per liter.

9. A bath as claimed in claim 6 or 7, having a pH not lower than 5.

10. A bath as claimed in claim 6 or 7 having a content of free nitric acid.

* * * * *